US008294450B2

(12) United States Patent
Lee et al.

(10) Patent No.: US 8,294,450 B2
(45) Date of Patent: Oct. 23, 2012

(54) START-UP CIRCUITS FOR STARTING UP BANDGAP REFERENCE CIRCUITS

(75) Inventors: Chia-Fu Lee, Hsin-Chu (TW); Gu-Huan Li, Zhubei (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 373 days.

(21) Appl. No.: 12/648,233

(22) Filed: Dec. 28, 2009

(65) Prior Publication Data

US 2011/0025291 A1 Feb. 3, 2011

Related U.S. Application Data

(60) Provisional application No. 61/230,351, filed on Jul. 31, 2009.

(51) Int. Cl.
*G05F 3/16* (2006.01)

(52) U.S. Cl. ..... 323/316; 323/315; 327/539

(58) Field of Classification Search ..... 323/316, 323/315; 327/539
See application file for complete search history.

(56) References Cited

U.S. PATENT DOCUMENTS 8,008,966 B2 * 8/2011 Cho ..... 327/539

* cited by examiner

*Primary Examiner* — Shawn Riley
(74) *Attorney, Agent, or Firm* — Slater & Matsil, L.L.P.

(57) ABSTRACT

An integrated circuit structure includes a bandgap reference circuit and a start-up circuit. The bandgap reference circuit includes a positive power supply node and a PMOS transistor including a source coupled to the positive power supply node. The start-up circuit is configured to be turned on during a start-up stage of the bandgap reference circuit, and to be turned off after the start-up stage. The start-up circuit includes a switch configured to interconnect a gate and a drain of the PMOS transistor during the start-up stage, and to disconnect the gate of the PMOS transistor from the drain of the PMOS transistor after the start-up stage.

19 Claims, 5 Drawing Sheets

START-UP CIRCUITS FOR STARTING UP BANDGAP REFERENCE CIRCUITS

This application claims the benefit of U.S. Provisional Application No. 61/230,351 filed on Jul. 31, 2009, entitled "Start-Up Circuit for Band-Gap Circuit Operated Under a Wide Range of Power Supply," which application is hereby incorporated herein by reference.

TECHNICAL FIELD

This application relates generally to integrated circuits and more particular to start-up circuits for starting up voltage reference circuits implemented using bandgap techniques.

BACKGROUND

Bandgap reference circuits are widely used in analog circuits for providing stable, voltage-independent, and temperature-independent reference voltages. The bandgap reference circuits operate on the principle of compensating the negative temperature coefficient of a base-emitter junction voltage VBE of a bipolar transistor with the positive temperature coefficient of thermal voltage VT, with thermal voltage VT being equal to kT/q, wherein k is Boltzmann constant, T is absolute temperature, and q is electron charge ($1.6\times10^{-19}$ coulomb). At room temperature, the variation of VBE with temperature is −2.2 mV/C, while the variation of thermal voltage VT with temperature is +0.086 mV/C.

As the name suggests, the voltages generated by the bandgap reference circuits are used as references, and hence the outputted reference voltages need to be highly stable. To be specific, the outputted reference voltages need to be free from temperature variations, voltage variations, and process variations. However, the power supply voltages provided to the bandgap reference circuits are often not stable and may have high variations. The variation in the power supply voltages adversely affects the operation of bandgap references circuits.

FIG. 1 illustrates a bandgap reference circuit and a start-up circuit for starting up the bandgap reference circuit. The start-up circuit includes PMOS transistors P2' and Psu'. During the standby time of the bandgap reference circuit, voltage VA' at node A' is equal to positive power supply voltage VDD', and voltage VB' at node B' is equal to power supply voltage VSS'. To activate the start-up circuit, a low voltage is applied to node EN_L', so that PMOS transistor Psu' is turned on. Accordingly, voltage VB' is increased, and the output voltage (which is voltage VA') of operational amplifier OP' is reduced. With the reduction in voltage VA', PMOS transistor P1' is turned on and the bandgap reference circuit starts to function.

The reduction in voltage VA' also results in PMOS transistor P2' being less conductive, and the voltage at node EN_L' increases. Eventually, the increase in the voltage at node EN_L' results in PMOS transistor Psu' to be turned off and the bandgap reference circuit functions by itself.

The conventional circuit, as shown in FIG. 1, suffers from drawbacks. The start-up of the bandgap reference circuit is performed by using PMOS transistor Psu' to charge node B' in order to change the output of operational amplifier OP'. The start-up time is accordingly long due to the response time of operational amplifier OP'. Further, since positive power supply voltage VDD' may vary in a wide range, when power supply voltage VDD' is low, the current passing through PMOS transistor Psu' is low, and hence the charging time of node B' is long, which means that the start-up time is long.

Unfortunately, the problem of the long start-up time cannot be solved by increasing the driving capability of PMOS transistor Psu' due to the small design margin. The small design margin is due to the fact that the driving capability of PMOS transistor Psu' can neither be high nor low. The driving current of PMOS transistor Psu' cannot be too low because otherwise, the start-up time is long. On the other hand, the driving current of PMOS transistor Psu' cannot be too high. Otherwise, after the start-up stage of the bandgap reference circuit, the voltage at node EN_L' may not be low enough for turning off PMOS transistor Psu'. This causes unnecessary power consumption. Further, since PMOS transistor Psu' provides bias currents to resistors R1', R2', and R3' and bipolar transistors Q1' and Q2', the bias condition is adversely affected and the output voltage of the bandgap reference circuit is adversely affected.

SUMMARY

In accordance with one aspect of the embodiment, an integrated circuit structure includes a bandgap reference circuit and a start-up circuit. The bandgap reference circuit includes a positive power supply node and a PMOS transistor including a source coupled to the positive power supply node. The start-up circuit is configured to be turned on during a start-up stage of the bandgap reference circuit and to be turned off after the start-up stage. The start-up circuit includes a switch configured to interconnect a gate and a drain of the PMOS transistor during the start-up stage and to disconnect the gate of the PMOS transistor from the drain of the PMOS transistor after the start-up stage.

Other embodiments are also disclosed.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative of specific ways to make and use the embodiments and do not limit the scope of the disclosure.

A novel start-up circuit for starting up a bandgap reference circuit is provided in accordance with an embodiment. The variations and the operation of the embodiment are discussed. Throughout the various views and illustrative embodiments, like reference numbers are used to designate like elements.

Figure 2:
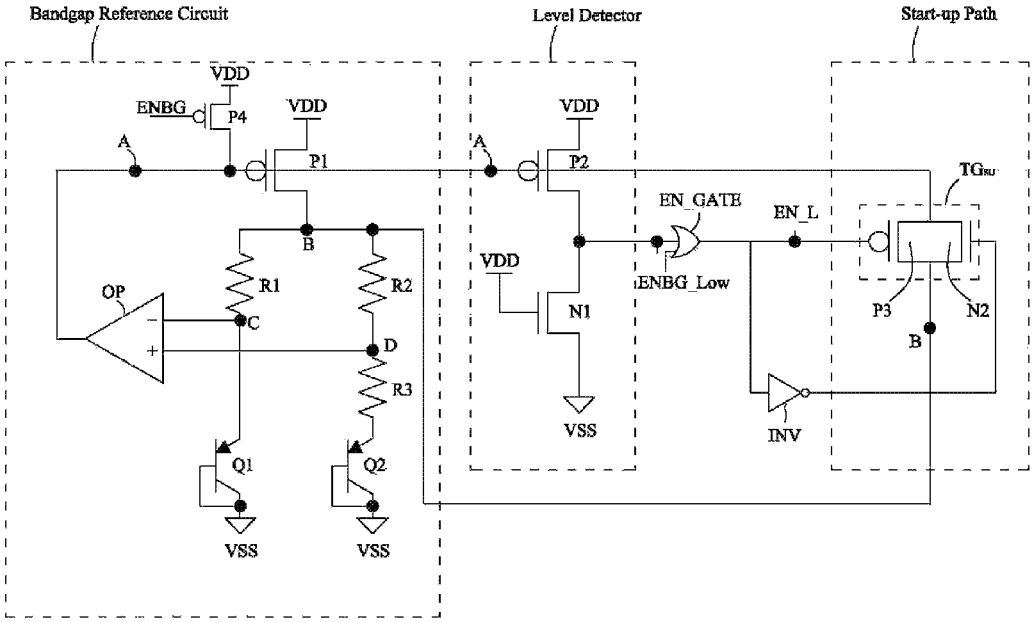
FIGS. 2 through 4 are bandgap reference circuits and start-up circuits in accordance with the embodiments.

FIG. 2 illustrates an embodiment. A bandgap reference circuit includes operational amplifier OP having negative input C, positive input D, and output A. Resistor R1 is connected to negative input C. Bipolar transistor Q1 is coupled between negative input C and power supply voltage VSS, which may be the electrical ground. The emitter of bipolar transistor Q1 is connected to node C. The base and the collector of bipolar transistor Q1 are interconnected, and may be connected to power supply voltage VSS. Bipolar transistor Q1 is thus used as a diode.

Resistors R2 and R3 are connected to positive input D of operational amplifier OP. Bipolar transistor Q2 is serially coupled to resistors R2 and R3. The emitter of bipolar transistor Q2 is connected to resistor R3. The base and the collector of bipolar transistors Q2 are interconnected and may be connected to power supply voltage VSS. Bipolar transistor Q2 is thus also used as a diode.

Output A of operational amplifier OP is connected to the gate of PMOS transistor P1, which has a source coupled to a positive power supply node, which is at positive power supply voltage VDD, and a drain connected to node B and to resistors R1 and R2. The bandgap reference circuit may further include additional devices (not shown), which may form current mirrors with PMOS transistor P1 and used for modifying the output voltage.

The bandgap reference circuit is connected to a start-up circuit, which is used to start-up the bandgap reference circuit from a standby state into an operating state. The start-up circuit includes PMOS transistor P2 and NMOS transistor N1, which form a level detector for detecting the voltage level at node A. The start-up circuit further includes a start-up path, which is turned on during the start-up stage of the bandgap reference circuit and is turned off after the bandgap reference circuit is started up.

Figure 3:
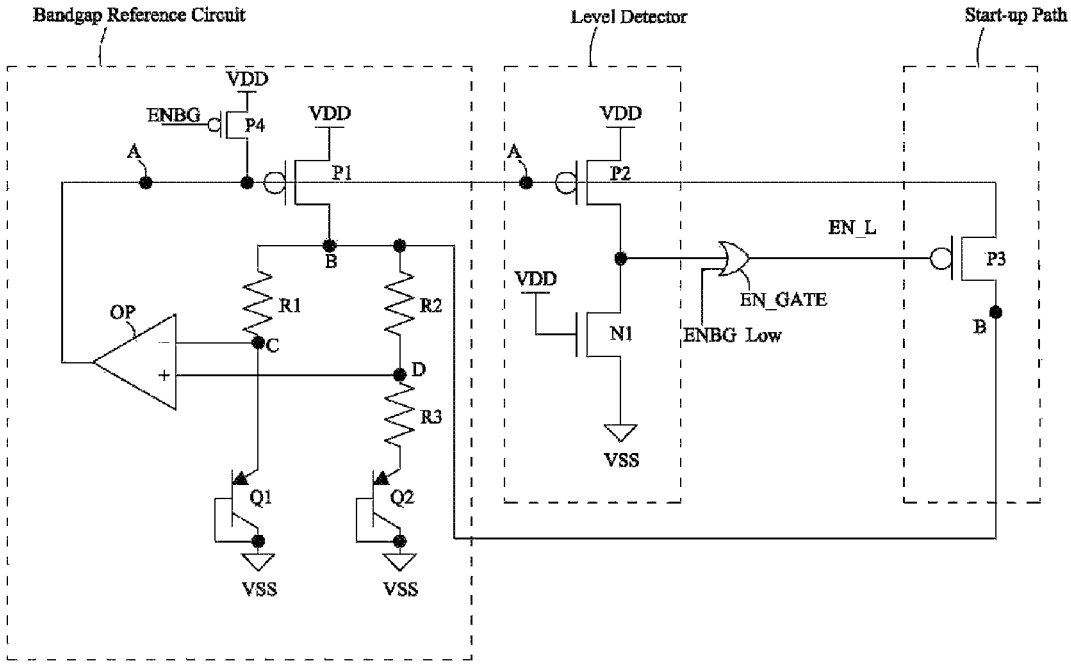
Figure 4:
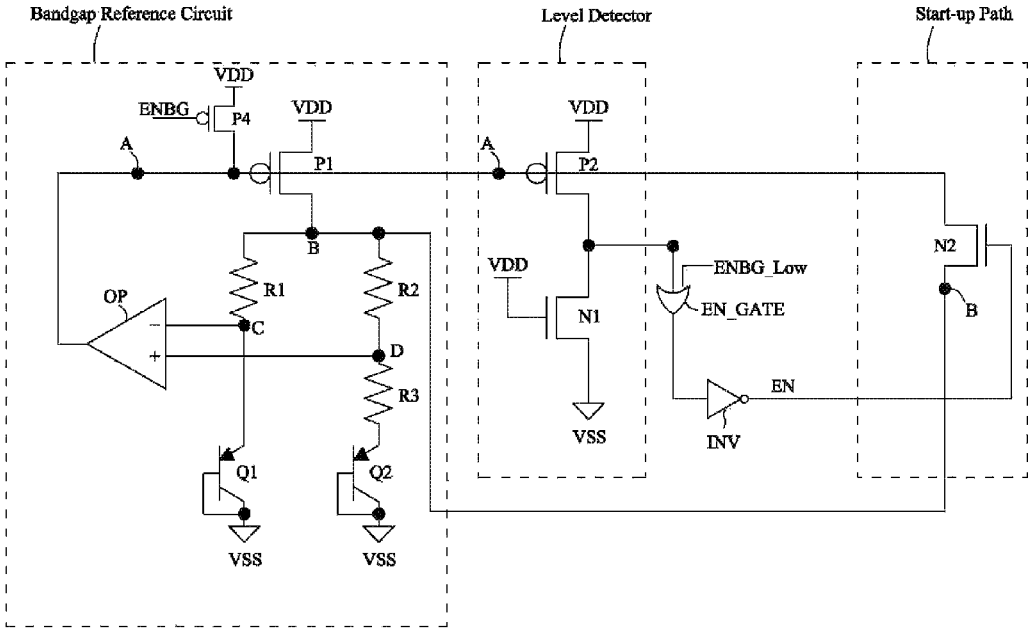

In an embodiment, the start-up path includes complementary metal-oxide-semiconductor (CMOS) gate TGsu, which may include PMOS transistor P3 and NMOS transistor N2. The source of PMOS transistor P3 is connected to the drain of NMOS transistor N2 and node A. The drain of PMOS transistor P3 is interconnected to the source of NMOS transistor N2 and node B. Accordingly, when CMOS gate TGsu is turned on, nodes A and B are shorted, while when CMOS gate TGsu is turned off, nodes A and B are disconnected from each other. Therefore, CMOS gate TGsu (and the PMOS transistor P3 in FIG. 3 and NMOS transistor N2 in FIG. 4) is also referred to as being a switch, with the gates of PMOS transistors P3 and NMOS transistor N2 being the control node of the switch. The gate of PMOS transistor P3 may be coupled to node EN_L, although additional signal control devices, such as OR gate EN_GATE may be coupled to node EN_L, to add more control to the voltage at node EN_L. OR gate EN_GATE includes an input node coupled to the drain of PMOS device P2, and another input node coupled to control signal ENBG_Low, which is at logic high when signal ENBG (a signal for enable the bandgap reference circuit) is at logic low, and at logic low when signal ENBG is at logic high. When signal ENBG_Low is at logic low (the bandgap reference circuit is enabled), the signal at the drain of PMOS device P2 is passed to node EN_L. The gate of NMOS transistor N2 may be coupled to an output of inverter INV, which has an input receiving the voltage on node EN_L. PMOS transistor P3 and NMOS transistor N2 are turned on and off simultaneously. It is observed that CMOS gate TGsu has a reduced voltage drop (when it is turned on) between node A and node B compared to a single PMOS transistor or a single NMOS transistor (refer to FIGS. 3 and 4). In alternative embodiments, CMOS gate TGsu may be replaced by PMOS transistor P3 without using NMOS transistor N2 (as shown in FIG. 3), or replaced by NMOS transistor N2 without using PMOS transistor P3 (as shown in FIG. 4).

Since the gates of PMOS transistors P1 and P2 are connected to the same node A, they may be laid out identical to each other, so that they may be turned on at the same time. NMOS transistor N1 may be a long-channel device that is always turned on with its gate coupled to positive power supply voltage VDD. In an embodiment, the channel length of NMOS transistor N1 may be greater than about 40 μm. With NMOS transistor N1 being a long-channel device, the current flowing through NMOS transistor N1 is low, and may be, for example, less than about 1 μA.

The operation of the bandgap reference circuit and the start-up circuit is discussed as follows. During the standby stage of the bandgap reference circuit, voltage VA at node A is equal to positive power supply voltage VDD, voltage VB at node B is equal to power supply voltage VSS, and the bandgap reference circuit is turned off. The start-up circuit is also turned off with CMOS gate TGsu being off. To start up the bandgap reference circuit, voltage VEN_L at node EN_L is decreased (for example, by inputting a low voltage to node EN_L), so that CMOS gate TGsu is turned on and node A is shorted to node B through CMOS gate TGsu. Since voltage VA at node A was equal to voltage VDD during the standby stage, the charges stored on node A are shared by nodes A and B, so that voltage VA is pulled down, and voltage VB is pulled up. With the reduction in voltage VA, transistor P1 is eventually turned on, and the bandgap reference circuit is started up. The increase in voltage VB also helps turn on PMOS transistor P1. PMOS device P4 is controlled by signal ENBG. When control signal ENBG is at logic high to enable the bandgap reference circuit, PMOS device P4 disconnects node A from power supple voltage node VDD, and voltage VA can change freely. Otherwise, if control signal ENBG is at logic low, voltage VA is fixed at voltage VDD.

It is observed that due to the shorting of nodes A and B, the start-up of the bandgap reference circuit no longer needs the involvement of operational amplifier OP to output a low voltage to node A. The reduction in voltage VA is now through the charge-sharing of nodes A and B. In other words, the reduction in voltage VA does not have to, although it still may, go through operational amplifier OP. The start-up time is thus significantly reduced.

Since PMOS transistors P1 and P2 may be identical, when PMOS transistor P1 is turned on, PMOS transistor P2 is also turned on, and hence voltage VEN_L is increased, and voltage VEN at node EN is lowered. Eventually, CMOS gate TGsu is turned off by the increased voltage VEN_L and the reduced voltage VEN, and the start-up circuit is turned off, leaving the bandgap reference generator to function by itself.

Figure 1:
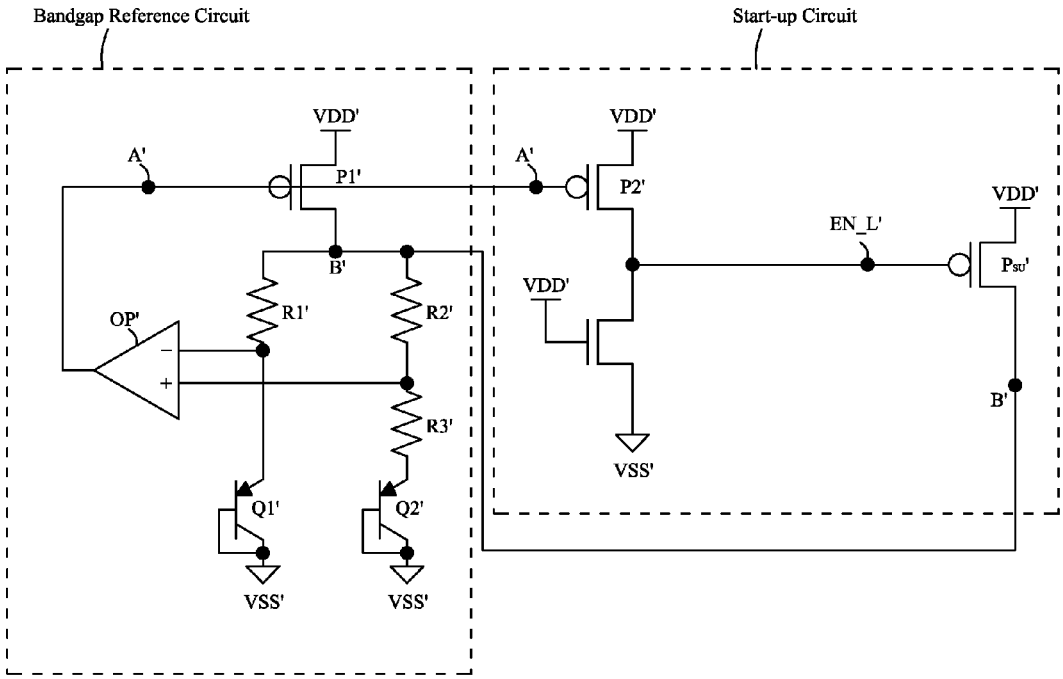
Fig. 1 (Prior Art)
FIG. 1 illustrates a conventional bandgap reference circuit and a start-up circuit.
Figure 5:
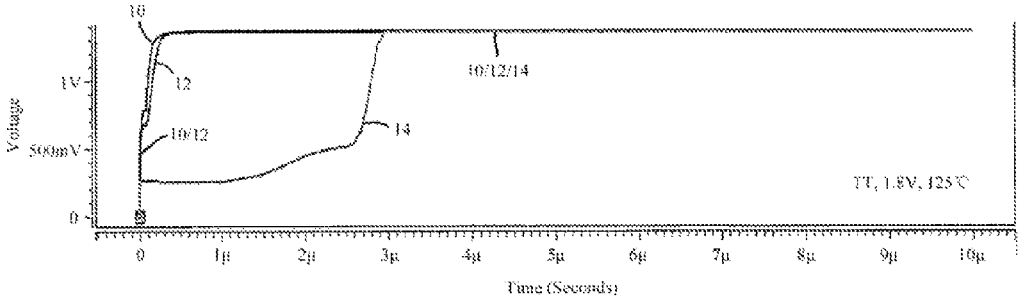
FIGS. 5 through 8 are simulation results, wherein the simulation results of the embodiments and the simulation results of the conventional start-up circuits are compared.
Figure 6:
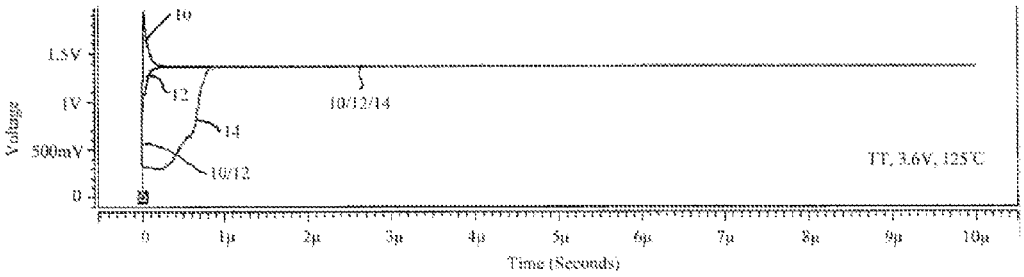
Figure 7:
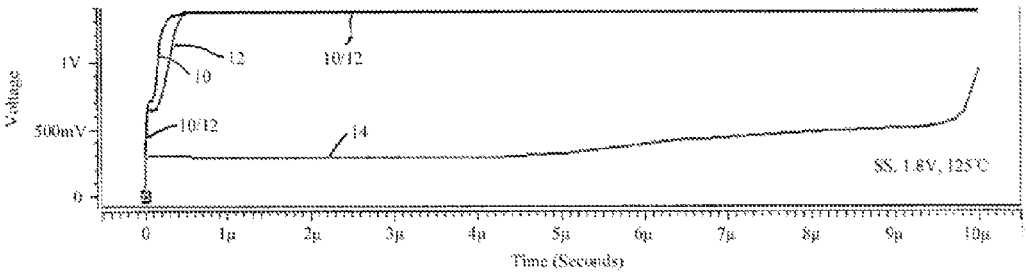
Figure 8:
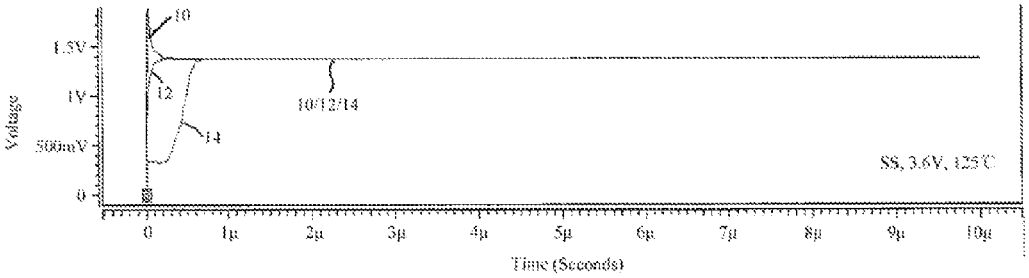

The embodiments have several advantageous features. FIGS. 5 through 8 illustrate simulation results, wherein voltages at node B' in FIG. 1 and node B in FIG. 2 are illustrated as functions of time. Lines 10 and 12 in FIGS. 5 through 8 are obtained from the circuit shown in FIG. 2, while line 14 is obtained from the conventional circuit shown in FIG. 1. FIG. 5 is obtained from circuits simulating the typical-typical (TT) process corner with positive power supply voltages VDD and VDD' equal to 1.8V. FIG. 6 is obtained from chips simulating the TT process corner with positive power supply voltages VDD and VDD' equal to 3.6V. FIG. 7 is obtained from chips simulating the slow-slow (SS) process corner with positive power supply voltages VDD and VDD' equal to 1.8V. FIG. 8 is obtained from chips simulating the SS process corner with positive power supply voltages VDD and VDD' equal to 3.6V. The simulation results revealed that regardless of the process variation (whether the chips are at the TT process corners or the SS process corner) and the variation in positive power supply voltage VDD/VDD', the embodiments have significantly shorter start-up times than the conventional bandgap reference circuit. For example, in FIG. 5, lines 10 and 12 (the embodiment) indicate that the start-up time of the embodiment is less than about 0.3 μs, while line 14 indicates that the start-up time of the conventional bandgap reference circuit is about 2.9 μs.

In addition to the fast start-up time, additional advantageous features of the embodiment include improved reliability in turning-off the start-up circuit and increased design margin.

Although the embodiments and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. An integrated circuit structure comprising:

a bandgap reference circuit comprising:

a positive power supply node; and a first PMOS transistor comprising a source coupled to the positive power supply node; and a start-up circuit configured to be turned on during a start-up stage of the bandgap reference circuit, and to be turned off after the start-up stage, wherein the start-up circuit comprises a switch configured to interconnect a gate and a drain of the first PMOS transistor during the start-up stage, and to disconnect the gate of the first PMOS transistor from the drain of the first PMOS transistor after the start-up stage.

2. The integrated circuit structure of claim 1, wherein the switch comprises a CMOS gate.

3. The integrated circuit structure of claim 1, wherein the switch comprises a PMOS transistor.

4. The integrated circuit structure of claim 1, wherein the switch comprises an NMOS transistor.

5. The integrated circuit structure of claim 1, wherein the bandgap reference circuit further comprises:

an operational amplifier comprising an output coupled to the gate of the first PMOS transistor;

a first resistor coupled between the drain of the first PMOS transistor and a negative input of the operational amplifier;

a first diode coupled between the negative input of the operational amplifier and an electrical ground;

a second resistor coupled between the drain of the first PMOS transistor and a positive input of the operational amplifier;

a third resistor coupled to the positive input of the operational amplifier; and a second diode coupled between the third resistor and the electrical ground.

6. The integrated circuit structure of claim 1, wherein the start-up circuit further comprises:

a second PMOS transistor comprising a gate connected to the gate of the first PMOS transistor, wherein a voltage at a drain of the second PMOS transistor is configured to control the switch; and an NMOS transistor comprising a drain connected to the drain of the first PMOS transistor, a source coupled to an electrical ground, and a gate coupled to the positive power supply node.

7. An integrated circuit structure comprising:

a bandgap reference circuit comprising:

a positive power supply node;

a first PMOS transistor comprising a gate, a drain, and a source, wherein the source of the first PMOS transistor is coupled to the positive power supply node;

a first current path coupled between the drain of the first PMOS transistor and an electrical ground;

a second current path coupled between the drain of the first PMOS transistor and the electrical ground; and an operational amplifier comprising a negative input coupled to a node in the first current path, a positive input coupled to a node in the second current path, and an output connected to the gate of the first PMOS transistor; and a start-up circuit comprising:

a second PMOS transistor comprising a gate connected to the gate of the first PMOS transistor; and a switch comprising a first end connected to the gate of the first PMOS transistor and a second end connected to the drain of the first PMOS transistor, wherein the switch is configured to be turned on by a first voltage at a drain of the second PMOS transistor, and turned off by a second voltage at the drain of the second PMOS transistor, and wherein the second voltage is higher than the first voltage.

8. The integrated circuit structure of claim 7, wherein the first current path comprises a first resistor and a first diode coupled in series, and wherein the second current path comprises a second resistor, a third resistor, and a second diode coupled in series.

9. The integrated circuit structure of claim 8, wherein the first diode is formed of a first bipolar transistor comprising a first collector, and a first base connected to the first collector, and wherein the second diode is formed of a second bipolar transistor comprising a second collector, and a second base connected to the second collector.

10. The integrated circuit structure of claim 7 further comprising an inverter comprising an input coupled to the drain of the second PMOS transistor, and an output coupled to a first control node of the switch.

11. The integrated circuit structure of claim 10, wherein the switch comprises a CMOS gate comprising a second control node coupled to the input of the inverter, and a third control node coupled to the output of the inverter.

12. The integrated circuit structure of claim 10, wherein the switch comprises an NMOS transistor comprising a gate coupled to the output of the inverter.

13. The integrated circuit structure of claim 7, wherein the switch comprises a PMOS transistor.

14. An integrated circuit structure comprising:

a bandgap reference circuit comprising:

a positive power supply node;

a first PMOS transistor comprising a source connected to the positive power supply node, a gate, and a drain;

a first current path coupled between the drain of the first PMOS transistor and an electrical ground, wherein the first current path comprises a first resistor and a first diode coupled in series;

a second current path coupled between the drain of the first PMOS transistor and the electrical ground, wherein the second current path comprises a second resistor and a second diode coupled in series; and an operational amplifier comprising a negative input coupled to a node in the first current path, a positive input coupled to a node in the second current path, and an output coupled to the gate of the first PMOS transistor; and a start-up circuit comprising a CMOS gate comprising a second PMOS transistor and a first NMOS transistor, wherein a source of the second PMOS transistor is connected to a drain of the first NMOS transistor and the gate of the first PMOS transistor, and a drain of the second PMOS transistor is connected to a source of the first NMOS transistor and the drain of the first PMOS transistor.

15. The integrated circuit structure of claim 14 further comprising an inverter configured to keep a gate voltage of the second PMOS transistor inverted from a gate voltage of the first NMOS transistor.

16. The integrated circuit structure of claim 14 further comprising:

a third PMOS transistor comprising a gate connected to the gate of the first PMOS transistor, wherein a drain voltage of the third PMOS transistor is configured to control a status of the CMOS gate; and a second NMOS transistor comprising a drain connected to the drain of the third PMOS transistor, a source coupled to the electrical ground, and a gate coupled to the positive power supply node.

17. The integrated circuit structure of claim 16 further comprising an inverter comprising an input coupled to the drain of the second PMOS transistor and the drain of the third PMOS transistor, and an output coupled to a gate of the second NMOS transistor.

18. The integrated circuit structure of claim 16, wherein the second NMOS transistor has a channel length greater than about 40 μm.

19. The integrated circuit structure of claim 14, wherein the first diode is formed of a first bipolar transistor comprising a first collector, and a first base connected to the first collector, and the second diode is formed of a second bipolar transistor comprising a second collector, and a second base connected to the second collector.

* * * * *